US011054779B2

(12) United States Patent
Tanaka et al.

(10) Patent No.: US 11,054,779 B2
(45) Date of Patent: Jul. 6, 2021

(54) IMAGE FORMING APPARATUS INCLUDING A SPEED CHANGING UNIT

(71) Applicant: FUJIFILM Business Innovation Corp., Tokyo (JP)

(72) Inventors: Satoshi Tanaka, Kanagawa (JP); Junichi Ishibashi, Kanagawa (JP); Keiji Sanekata, Kanagawa (JP); Chihiro Hagiwara, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/275,724

(22) Filed: Feb. 14, 2019

(65) Prior Publication Data

US 2020/0096924 A1 Mar. 26, 2020

(30) Foreign Application Priority Data

Sep. 21, 2018 (JP) ..... JP2018-176964

(51) Int. Cl.
*G03G 15/00* (2006.01)
*G03G 15/08* (2006.01)

(52) U.S. Cl.
CPC ..... *G03G 15/5008* (2013.01); *G03G 15/0887* (2013.01)

(58) Field of Classification Search
CPC ..... G03G 15/5008; G03G 15/0887; G03G 15/0848–0855; G03G 15/5054; G03G 15/5058; G03G 21/203
See application file for complete search history.

(56) References Cited

U.S. PATENT DOCUMENTS 9,535,378 B2 * 1/2017 Sakamaki ..... G03G 15/20
9,772,575 B1 * 9/2017 Yamaura ..... G03G 15/1605

FOREIGN PATENT DOCUMENTS

JP 2001154538 A * 6/2001 ..... G03G 15/065
JP 2011-118332 A 6/2011
JP 2014077909 A * 5/2014
JP 2016-114923 A 6/2016

OTHER PUBLICATIONS

Machine translation into English of JP 2016-114923 (Year: 2016).*
Machine translation of JP-2001154538 (Year: 2011).*
Machine translation of JP-2014077909 (Year: 2014).*

* cited by examiner

*Primary Examiner* — Arlene Heredia
(74) *Attorney, Agent, or Firm* — Sughrue Mion, PLLC

(57) ABSTRACT

An image forming apparatus includes image forming units, supply devices, and a speed changing unit. The image forming units form toner images of different colors. Each of the image forming units includes a developing device containing toner of a corresponding one of the different colors. The supply devices supply toner to the developing devices. In a high development mode, the speed changing unit changes a drive rotational speed of the developing device or a speed of an image formation operation to a lower speed compared with a case of a normal mode. The normal mode is a mode in which a toner image is formed with a normal amount of toner adhesion. The high development mode is a mode in which at least one of the image forming units forms a toner image with a large amount of toner adhesion.

3 Claims, 5 Drawing Sheets

IMAGE FORMING APPARATUS INCLUDING A SPEED CHANGING UNIT

CROSS-REFERENCE TO RELATED APPLICATIONS

This application is based on and claims priority under 35 USC 119 from Japanese Patent Application No. 2018-176964 filed Sep. 21, 2018.

BACKGROUND

(i) Technical Field

The present disclosure relates to an image forming apparatus and a non-transitory computer readable medium.

(ii) Related Art

Japanese Unexamined Patent Application Publication No. 2016-114923 discloses an image forming apparatus. The image forming apparatus changes the toner density of the developer of a developing device in accordance with a white-toner brightness setting value so as to adjust the developing capacity of the developing device. In addition, the image forming apparatus mixes the developer in the developing device by using mixing units during the mixing time determined by the white-toner supply amount, which has been integrated from the time point of the adjustment of the developing capacity, and the absolute humidity near the developing device.

Japanese Unexamined Patent Application Publication No. 2011-118332 discloses an image forming apparatus which determines whether or not the toner is to be replaced, in accordance with the type of a selected recording medium and which replaces the toner. The toner is replaced in order that deteriorated toner in a developing device is ejected for suppression of toner splatters.

In the case where a large amount of toner adhesion on a recording medium is required and where the toner, having a high toner density, in a developing device is used, a decrease in the toner charge may cause occurrence of toner splatters.

SUMMARY

Aspects of non-limiting embodiments of the present disclosure relate to an image forming apparatus which suppresses occurrence of toner splatters compared with the configuration in which the drive rotational speed of the developing devices or the speed of an image formation operation is kept at the same speed as the normal speed when a large amount of toner is to be adhered.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including image forming units, supply devices, and a speed changing unit. The image forming units form toner images of different colors. Each of the image forming units includes a developing device containing toner of a corresponding one of the different colors. The supply devices supply toner to the developing devices. In a high development mode, the speed changing unit changes a drive rotational speed of the developing device or a speed of an image formation operation to a lower speed compared with a case of a normal mode. The normal mode is a mode in which a toner image is formed with a normal amount of toner adhesion. The high development mode is a mode in which at least one of the image forming units forms a toner image with a large amount of toner adhesion.

BRIEF DESCRIPTION OF THE DRAWINGS

Exemplary embodiment of the present disclosure will be described in detail based on the following figures, wherein.

DETAILED DESCRIPTION

An exemplary embodiment for carrying out the present disclosure (hereinafter referred to as the present exemplary embodiment) will be described below. In the description below, the direction indicated by arrow X in the figures indicates the apparatus width direction. The direction indicated by arrow Y indicates the apparatus height direction. The direction orthogonal to the apparatus width direction and the apparatus height direction (the direction indicated by arrow Z) indicates the apparatus depth direction.

Figure 1:
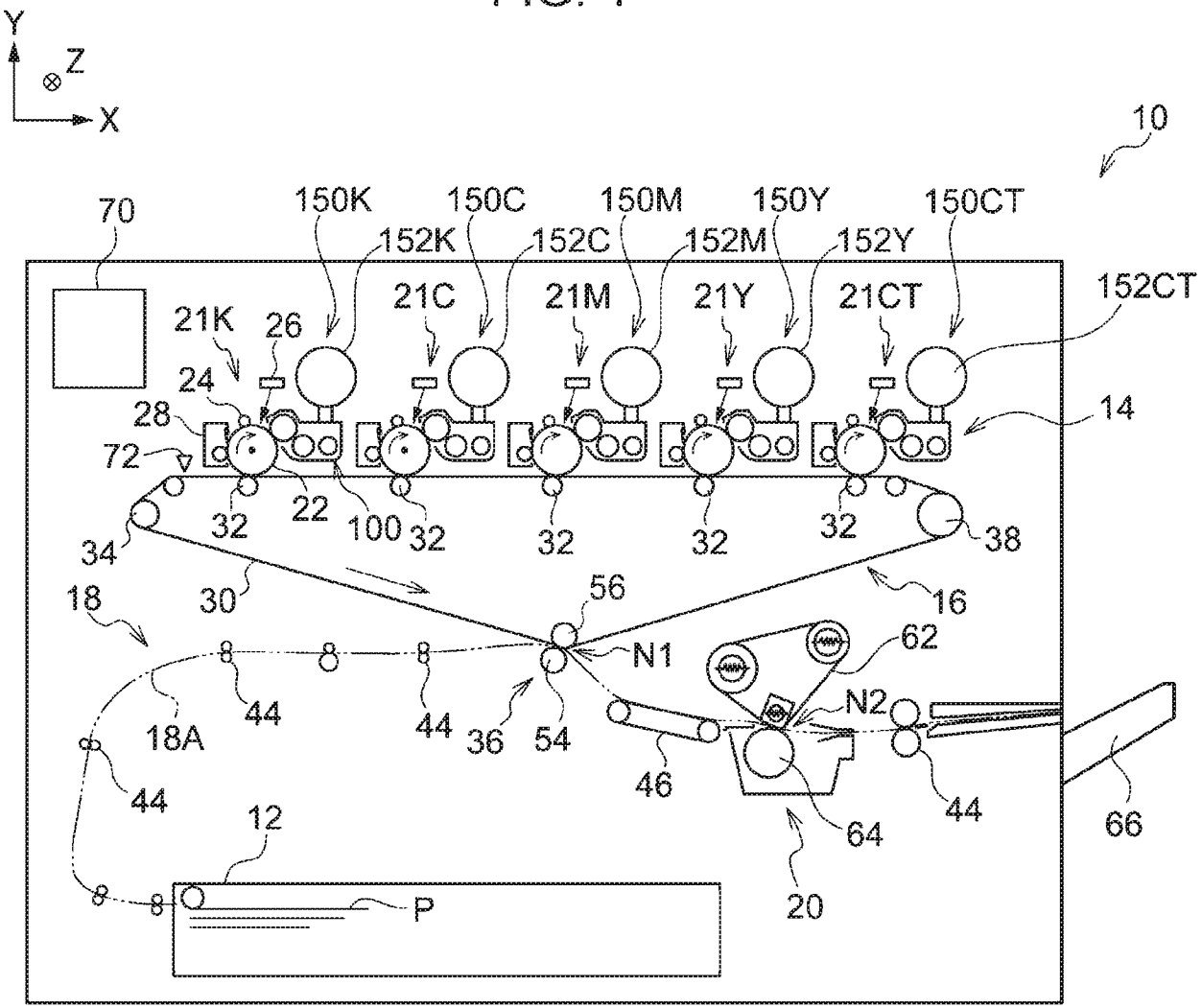
FIG. 1 is a schematic diagram illustrating the configuration of an image forming apparatus according to an exemplary embodiment.

FIG. 1 illustrates an image forming apparatus 10 according to an exemplary embodiment. The image forming apparatus (see FIG. 1) according to the present exemplary embodiment will be first described. Then, a developing device 100 and a toner supply device 150 will be described.

The Overall Configuration of the Image Forming Apparatus

As illustrated in FIG. 1, the image forming apparatus 10 is an electrophotographic apparatus including a recording medium holding unit 12, a toner image forming unit 14, a transfer device 16, a recording-medium transport device 18, a fixing device 20, and a controller 70.

The recording medium holding unit 12 has a function of holding sheets P as exemplary recording media on which no images have been formed. The recording medium holding unit 12 has a configuration in which multiple types of sheets P are held (not illustrated). Sheets P of each type are transported by the recording-medium transport device 18.

The toner image forming unit 14 has a function of performing a charging process, an exposure process, and a developing process to form a toner image held by an intermediate transfer belt 30 which is described below and which is included in the transfer device 16. For example, the toner image forming unit 14 includes single color units 21Y, 21M, 21C, 21K, and 21CT forming toner images on corresponding photoreceptors 22 by using toner of different colors (yellow (Y), magenta (M), cyan (C), black (K), and spot color (CT)). In addition, for example, the toner image forming unit 14 is capable of forming a toner image of multiple colors in accordance with image data. The spot color (CT) toner is toner of a color other than yellow (Y), magenta (M), cyan (C), and black (K). Examples of spot color (CT) toner include white (W) toner, clear color (CR, transparent color) toner, gold toner, and silver toner. The single color units 21Y, 21M, 21C, 21K, and 21CT are exemplary image forming units. The single color unit 21CT for a spot color is an exemplary spot-color image forming unit.

The single color units 21Y, 21M, 21C, 21K, and 21CT have substantially the same configuration except for the colors of toner images formed by the units. Hereinafter, when the single color units 21Y, 21M, 21C, 21K, and 21CT and their components are not necessarily differentiated from each other, description will be made by skipping the symbols (Y, M, C, K, and CT) of the single color units 21Y, 21M, 21C, 21K, and 21CT. Each single color unit 21 includes one of the photoreceptors 22, a charging device 24, an exposure device 26, a developing device 100, and a cleaning device 28.

The transfer device 16 has a function of holding toner images of the colors, which are formed by the respective single color units 21, and transferring the toner images onto a sheet P having been transported. The transfer device 16 includes the intermediate transfer belt 30, five transfer rollers 32, a driving roller 38, a second transfer unit 36, and a tension roller 34. The intermediate transfer belt 30 is endless. The five transfer rollers 32 and the respective photoreceptors 22 form nips with the intermediate transfer belt 30 interposed in between. The intermediate transfer belt 30 moves around in the arrow direction by the driving roller 38. In the present exemplary embodiment, for example, the single color units 21CT, 21Y, 21M, 21C, and 21K are arranged in this sequence from the upstream side to the downstream side in the direction in which the intermediate transfer belt 30 moves around. Thus, toner images formed on the photoreceptors 22 by the single color units 21CT, 21Y, 21M, 21C, and 21K are transferred by the transfer rollers 32 so as to be superposed on top of one another on the intermediate transfer belt 30.

The second transfer unit 36 includes a transfer roller 54 and an opposing roller 56. The transfer roller 54 is in contact with the surface, on which the toner image is held, of the intermediate transfer belt 30. The opposing roller 56 is disposed so as to be opposite the transfer roller 54 with the intermediate transfer belt 30 interposed in between. The second transfer unit 36 transfers the composite toner image of the colors, which is held on the intermediate transfer belt 30, onto a sheet P having been transported.

The recording-medium transport device 18 has a function of transporting a sheet P so that the sheet P passes through the nip N1 in the second transfer unit 36 and through the nip N2 in the fixing device 20. The recording-medium transport device 18 includes multiple transport rollers 44 and a transport belt 46. The transport rollers 44 form pairs of rollers disposed so as to be in contact with each other. The transport rollers 44 transport a sheet P, which is held in the recording medium holding unit 12, along the transport path 18A.

The transport belt 46 has a configuration in which an endless belt goes round a pair of rollers disposed separately. The transport belt 46 is disposed downstream of the second transfer unit 36 and upstream of the fixing device 20 in the transport direction of a sheet P. The transport belt 46 transports a sheet P, on which a toner image has been transferred by the second transfer unit 36, to the fixing device 20 along the transport path 18A.

The fixing device 20 has a function of fixing a toner image, which has been transferred (second transfer) onto a sheet P by the transfer device 16, in the nip N2. The fixing device 20 includes a heating unit 62 and a pressure roller 64. The heating unit 62 has an endless belt moving around. The pressure roller 64 is pressed against the heating unit 62. A sheet P is transported through the nip N2 between the heating unit 62 and the pressure roller 64. Thus, the toner image on the sheet P is fixed through heating and applying pressure.

The controller 70 has a function of controlling the units of the image forming apparatus 10. For example, the controller 70 controls the units of the image forming apparatus 10 (causes the units to perform their operations) in accordance with image formation data received from an external apparatus (not illustrated). The image formation data includes image data (image information) for causing the single color units 21 to form toner images and data used for other image formation operations.

The image forming apparatus 10 includes a density sensor 72 downstream of the single color units 21CT, 21Y, 21M, 21C, and 21K in the direction in which the intermediate transfer belt 30 moves around. The density sensor 72 detects the density of a toner image having been transferred onto the intermediate transfer belt 30. In the present exemplary embodiment, as the density sensor 72, a reflective optical sensor having a light emitting device and a light receiving device is used. However, this is not limiting. Another known sensor detecting the density of a toner image may be applied.

Operations of the Image Forming Apparatus

Operations of the image forming apparatus 10 will be described.

The controller 70 having received image formation data from an external apparatus (not illustrated) operates the toner image forming unit 14, the transfer device 16, the recording-medium transport device 18, and the fixing device 20. In the toner image forming unit 14, the photoreceptors 22 are charged by the charging devices 24, and are exposed to light by the exposure devices 26. Thus, electrostatic latent images are formed, and the developing devices 100 develop the electrostatic latent images on the photoreceptors 22 as toner images. As a result, toner images are formed on the photoreceptors 22. For example, when white (W) toner is used as spot color toner of the single color unit 21CT, a toner image of W color corresponding to data for the background in the image data is formed.

A voltage (first transfer voltage) is applied from the power supply (not illustrated) to the transfer rollers 32. The driving roller 38 driven by a driving source (not illustrated) causes the intermediate transfer belt 30 to move around in the arrow direction. As a result, first transfer is performed on the intermediate transfer belt 30 so that toner images of the colors are superposed on top of one another.

Conforming to the timing at which the composite toner image of the colors held on the intermediate transfer belt 30 moving around reaches the nip N1, the recording-medium transport device 18 feeds a sheet P to the nip N1. In the second transfer unit 36, a voltage (second transfer voltage) is applied from the power source (not illustrated) to a power supply roller (not illustrated) that is in contact with the periphery of the opposing roller 56. Thus, second transfer to the sheet P passing through the nip N1 is performed on the toner image of the colors.

The recording-medium transport device 18 feeds the sheet P, on which the toner image of the colors has been transferred through second transfer, to the nip N2. As a result, the fixing device 20 fixes the toner image of the colors on the sheet P passing through the nip N2. Thus, an image is formed on the sheet P. After that, the sheet P is ejected to an output unit 66 by using transport rollers 44.

The Developing Device

The developing device 100 will be described.

Figure 2:
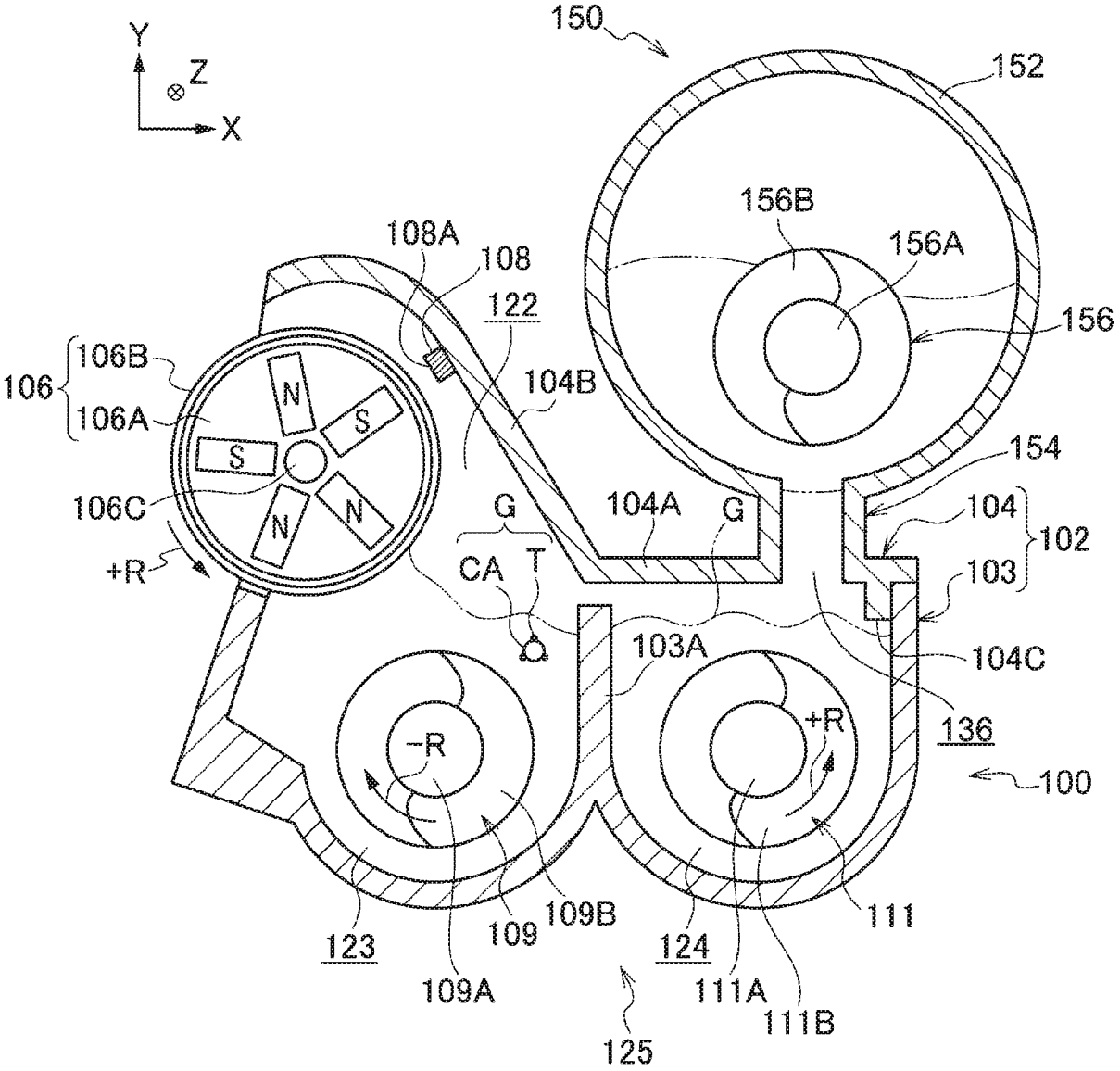
FIG. 2 is a plan view of a developing device used in the image forming apparatus according to the exemplary embodiment.

As illustrated in FIG. 2, the developing device 100 includes a housing 102 containing a developer G, a developing roller 106 on which the developer G is held, a trimmer 108 which is an exemplary developer regulation member that regulates the thickness of the developer G layer on the periphery of the developing roller 106, and a developer mixing/transport unit 125. The developer mixing/transport unit 125 includes a first mixing/transport chamber 123 and a second mixing/transport chamber 124 adjacent to the first mixing/transport chamber 123. The first mixing/transport chamber 123 is provided with a first auger 109, and the second mixing/transport chamber 124 is provided with a second auger 111.

As illustrated in FIG. 2, an example of the developer G is constituted by a two-component developer containing toner particles T and magnetic carrier beads CA. The toner particles T are exemplary negative-polarity charged particles. The magnetic carrier beads CA are exemplary positive-polarity magnetic particles.

The housing 102 includes a container body 103 and a covering member 104 covering the top of the container body 103. The housing 102 also includes a developing roller chamber 122 housing the developing roller 106, and the developer mixing/transport unit 125 (the first mixing/transport chamber 123 and the second mixing/transport chamber 124) disposed obliquely downward from the developing roller chamber 122.

The container body 103 includes a partition 103A serving as a partition between the first mixing/transport chamber 123 and the second mixing/transport chamber 124. The container body 103 is provided with openings (not illustrated), for communicating with the first mixing/transport chamber 123 and the second mixing/transport chamber 124, on both the ends of the partition 103A in the Z direction.

The covering member 104 includes an upper wall 104A, an inclined wall 104B, and an engaging unit 104C. The upper wall 104A is disposed above the second mixing/transport chamber 124. The inclined wall 104B extends obliquely upward to the left from the left end portion of the upper wall 104A, and covers the developing roller chamber 122. The engaging unit 104C extends downward from an end portion of the upper wall 104A and is engaged into the container body 103. The trimmer 108 is attached to the inner side surface of the inclined wall 104B.

The upper wall 104A is provided with a developer supply port 136 above the second mixing/transport chamber 124. The developer supply port 136 is connected to a lower end portion of a toner transport unit 154 which is described below and which is used to supply new toner particles T.

The developing roller 106 includes a magnet roller 106A and a developing sleeve 106B. The column-shaped magnet roller 106A is fixed to the container body 103 by using a shaft 106C. The column-shaped developing sleeve 106B is supported so as to be movable around the magnet roller 106A. The magnet roller 106A includes multiple magnetic poles along its periphery (circumferential direction).

The developer G in the first mixing/transport chamber 123 is transported through rotation in the +R direction of the developing sleeve 106B while being held on the developing sleeve 106B. The developer G held on the developing sleeve 106B goes between the periphery of the developing sleeve 106B and a front end portion 108A of the trimmer 108. Thus, the thickness of the layer of the developer G is regulated, and the developer G is transported to a developing area opposite a photoreceptor 22 (see FIG. 1).

The first auger 109 includes a rotation shaft 109A and a transport blade 109B. The rotation shaft 109A is disposed along the Z direction. The helical transport blade 109B is supported on the periphery of the rotation shaft 109A. The first auger 109 transports the developer G, while mixing the developer G, for example, by rotating in the −R direction.

The second auger 111 includes a rotation shaft 111A and a transport blade 111B. The rotation shaft 111A is disposed along the Z direction. The helical transport blade 111B is supported on the periphery of the rotation shaft 111A. The second auger 111 transports the developer G, while mixing the developer G in the direction opposite to the direction of the first auger 109, for example, by rotating in the +R direction. Mixing the developer G causes the toner particles T and the magnetic carrier beads CA to come into contact, resulting in charged toner. The rotation of the first auger 109 and the rotation of the second auger 111 cause the developer G in the first mixing/transport chamber 123 and the second mixing/transport chamber 124 to be transported in the opposite Z-axis directions, resulting in circulation of the developer G. The developer G transported by the first auger 109 is supplied to the developing roller 106.

The Toner Supply Device

The toner supply device 150 will be described.

As illustrated in FIG. 1, the image forming apparatus 10 includes the toner supply devices 150Y, 150M, 150C, 150K, and 150CT which supply the toner of the respective different colors (yellow (Y), magenta (M), cyan (C), black (K), and spot color (CT)) to the developing devices 100 of the single color units 21Y, 21M, 21C, 21K, and 21CT. The toner supply devices 150Y, 150M, 150C, 150K, and 150CT are provided with toner cartridges 152Y, 152M, 152C, 152K, and 152CT containing toner of the respective different colors (yellow (Y), magenta (M), cyan (C), black (K), and spot color (CT)). The toner supply devices 150Y, 150M, 150C, 150K, and 150CT are exemplary supply devices. The toner supply devices 150Y, 150M, 150C, 150K, and 150CT have the substantially same configuration except for the color of toner which is housed and transported. When the toner colors are not necessarily differentiated from each other, the toner supply devices 150Y, 150M, 150C, 150K, and 150CT will be described by skipping the symbols (Y, M, C, K, and CT).

As illustrated in FIG. 2, a toner supply device 150 includes a toner cartridge 152 described above and the toner transport unit 154 connected to a lower portion of the toner cartridge 152. The toner transport unit 154 is connected to an end portion, which is disposed in the axis direction, of the toner cartridge 152.

The tube-shaped toner cartridge 152 includes therein a transport member 156 which transports toner. For example, the transport member 156 includes a rotation shaft 156A and a transport blade 156B. The rotation shaft 156A is disposed in the axis direction of the toner cartridge 152. The helical transport blade 156B is supported on the periphery of the rotation shaft 156A. The transport member 156 transports the toner in the toner cartridge 152 to the toner transport unit 154 through rotation of the rotation shaft 156A.

The toner transport unit 154 has an end portion which is disposed upstream of the transport direction and which is connected to the toner cartridge 152. The toner transport unit 154 has an end portion which is disposed downstream of the transport direction and which is connected to the developing device 100. The downstream end portion of the toner transport unit 154 is connected to an upstream end portion, which is disposed in the longitudinal direction (Z direction), of the second mixing/transport chamber 124 of the developing device 100. The toner transport unit 154 may be provided with a transport path (not illustrated) disposed in the horizontal direction, and the transport path may be provided, for example, with a transport member transporting toner.

The Configuration for Control of the Image Forming Apparatus 10

Figure 3:
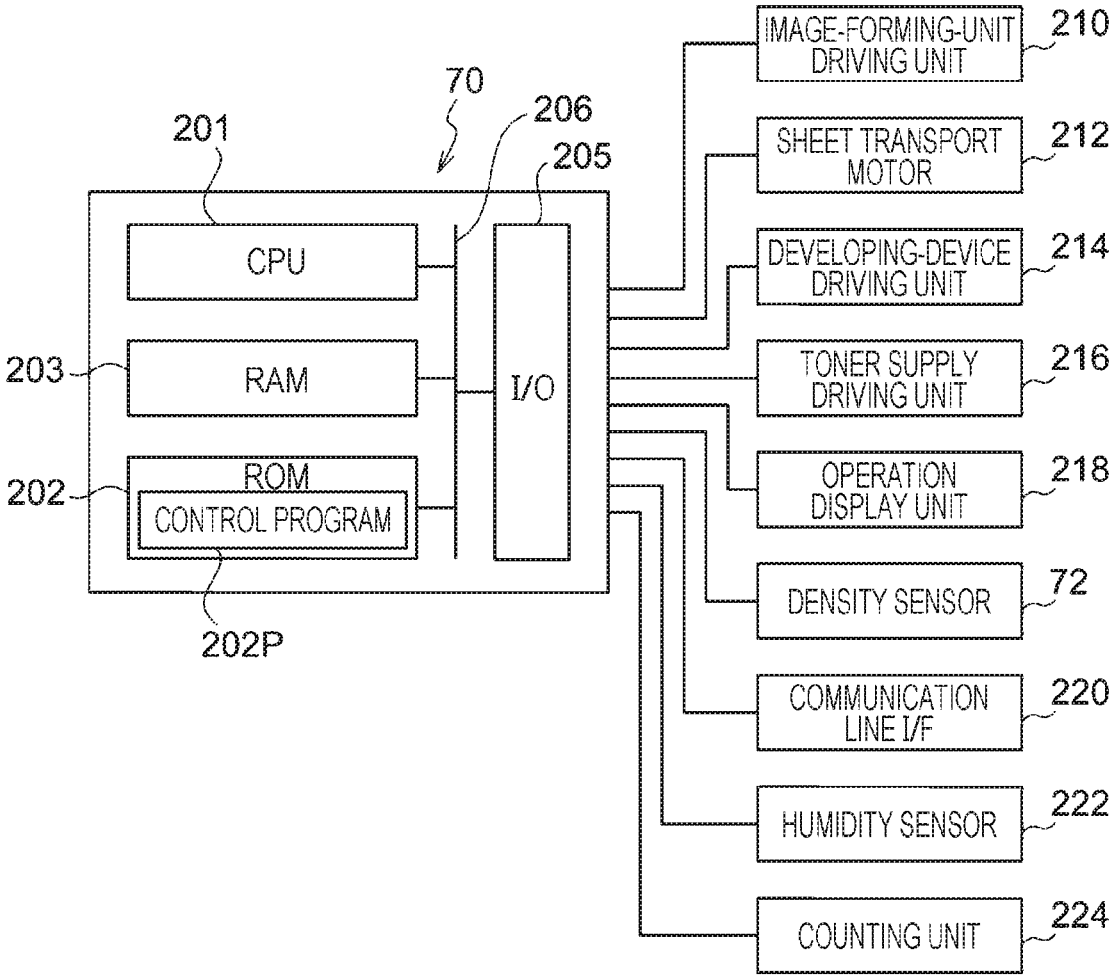
FIG. 3 is a diagram illustrating an exemplary configuration of a part of an electrical system in the image forming apparatus according to the exemplary embodiment.

Referring to FIG. 3, the configuration of a part of the electrical system of the image forming apparatus 10 will be described.

The controller 70 may be implemented, for example, by using a computer.

In the controller 70, a central processing unit (CPU) 201, a read only memory (ROM) 202, a random access memory (RAM) 203, and an input/output interface (I/O) 205 are connected to each other via a bus 206.

An image-forming-unit driving unit 210, a sheet transport motor 212, a developing-device driving unit 214, a toner supply driving unit 216, an operation display unit 218, the density sensor 72, a communication line I/F 220, a humidity sensor 222, and a counting unit 224 are connected to the I/O 205.

For example, the controller 70 causes the CPU 201 to execute a control program 202P installed in advance in the ROM 202, and perform data communication with the components connected to the I/O 205, according to the control program 202P. Thus, the controller 70 controls the image forming apparatus 10. The controller 70 may be connected to a nonvolatile storage unit such as a flash memory (not illustrated) via the bus 206.

The image-forming-unit driving unit 210 is connected to the single color units 21 of the toner image forming unit 14 and the units of the transfer device 16. The image-forming-unit driving unit 210 receives instructions from the controller 70, and drives the single color units 21 and the units of the transfer device 16. For example, the image-forming-unit driving unit 210 drives the rotation systems of the single color units 21 and the transfer device 16, thus controlling the image formation speed.

The sheet transport motor 212 is connected to the transport rollers 44 and the transport belt 46, for example, via driving systems such as gears. In response to driving the sheet transport motor 212, the transport rollers 44 are rotated, and the transport belt 46 moves around. The sheet transport motor 212 controls the transport speed of a sheet P in accordance with the image formation speed determined by the single color units 21 and the transfer device 16. The controller 70 controls the image-forming-unit driving unit 210 and the sheet transport motor 212, functioning as a speed changing unit which changes the image formation speed.

The developing-device driving unit 214 is connected to the units of the developing devices 100. The developing-device driving unit 214 receives instructions from the controller 70, and drives the units of the developing devices 100. For example, the developing-device driving unit 214 controls the rotation of the developing rollers 106, the first augers 109, and the second augers 111.

The toner supply driving unit 216 is connected to the units of the toner supply devices 150. The developing-device driving unit 214 receives instructions from the controller 70, and drives the units of the developing devices 100. For example, the toner supply driving unit 216 controls the rotation of the transport members 156 of the toner supply devices 150 so as to adjust the supply amount of toner supplied to the developing devices 100.

The operation display unit 218 receives instructions from a user of the image forming apparatus 10, and notifies the user of various information about the operation state of the image forming apparatus 10. The operation display unit 218 includes, for example, a touch-panel display on which display buttons, for implementing reception of operational instructions using programs, and various types of information are displayed, and hardware keys, such as a numeric keypad and a start button.

The communication line I/F 220, which is connected to a communication line (not illustrated), is an interface for performing data communication with information equipment such as personal computers (not illustrated) connected to the communication line. The communication line (not illustrated) may be a wired line, a wireless line, or a combination of these. For example, the communication line may receive, for example, image formation data from the information equipment (not illustrated).

The humidity sensor 222 is disposed inside the image forming apparatus 10, and detects the relative humidity of the inside of the image forming apparatus 10. The controller 70 acquires the relative humidity detected by the humidity sensor 222.

The counting unit 224 counts prints (formed-image count) or pixels (image density) on the basis of input information received by the operation display unit 218 or image formation data (including image information) received from an external apparatus (not illustrated). The controller 70 acquires information about the print count (formed-image count) or the pixel count (image density) obtained through counting by the counting unit 224.

The density sensor 72 detects the density of a toner image having been transferred to the intermediate transfer belt 30 as described above. The controller 70 acquires the density value indicating the density of the toner image detected by the density sensor 72.

The image forming apparatus 10 forms patch images constituted by reference toner images having a determined density, by using the toner image forming unit 14, and detects the toner image densities of the patch images having been transferred to the intermediate transfer belt 30, by using the density sensor 72. The controller 70 detects the toner densities of the developing devices 100 on the basis of the toner image densities of the patch images detected by the density sensor 72. The controller 70 compares the detected value of the toner density in each of the developing devices 100 with the determined control target value of the toner density in the developing device 100. The controller 70 determines whether the detected value of the toner density in the developing device 100 is higher or lower than the determined control target value of the toner density in the developing device 100. If the detected value of the toner density in the developing device 100 is lower than the determined control target value of the toner density in the developing device 100, the controller 70 adjusts the amount of toner supplied to the developing device 100 by the toner supply device 150, thus controlling the toner density in the developing device 100. In the present exemplary embodiment, for example, the rotational speed of the transport member 156 of the toner supply device 150 is controlled so that the amount of toner supplied to the developing device 100 is adjusted. The toner density in the developing device 100 indicates the ratio (%) of the mass of toner particles with respect to the total mass of toner particles and carrier beads.

The processes performed by the image forming apparatus 10 including the above-described components may be implemented through software by executing the control program 202P by using a computer including the controller 70.

The control program 202P is provided by being installed in advance in the ROM 202. This is not limiting. The control program 202P may be provided by being stored in a computer-readable recording medium, such as a compact disc-read-only memory (CD-ROM) or a memory card. Alternatively, for example, the control program 202P may be distributed through the communication line I/F 220.

In the present exemplary embodiment, as spot color (CT) toner of the single color unit 21CT, toner for decoration and appeal, such as clear (CR) toner, gold toner, or silver toner may be used in addition to white (W) toner. Usage of spot color (CT) toner is different from usage of normal color toner of yellow (Y), magenta (M), cyan (C), and black (K), and is, for example, for decoration and appeal. Thus, a larger amount of toner than that of a normal color is to be adhered. Therefore, the developing device 100 is to be used in the state in which the toner density in the developing device 100 is set to high. Consequently, the toner charge decreases. Accordingly, toner splatters (cloud) and the tainted background (fogging) of a sheet P are issues to be addressed. Even in the case of normal color toner other than spot color toner, a large amount of toner is sometimes to be adhered. Thus, a similar issue occurs. Therefore, the image forming apparatus 10 according to the present exemplary embodiment has a specific function of, when a large amount of toner is to be adhered, making the speed (image formation speed) of an image formation operation of the image forming apparatus 10 lower than the speed of the normal image formation operation.

To implement the specific function, the image forming apparatus 10 has, as the operation mode, the high development mode in which at least one of the single color units 21 forms a toner image with a large amount of toner adhesion, in addition to the normal mode in which a toner image is formed with a normal amount of toner adhesion.

In the high development mode, the control target value of the toner density in the developing device 100 of the single color unit 21 for a color (color for high toner adhesion), for which a large amount of toner is to be adhered, is changed to a value higher than the control target value of the toner density in the developing device 100 in the normal mode. The control target value of the toner density in the developing device 100 in the normal mode and the control target value (a higher control target value) of the toner density in the developing device 100 of the single color unit 21 for the color for high toner adhesion in the high development mode are stored in advance, for example, in the ROM 202 of the controller 70. The control target value is an exemplary setting value. The controller 70 functions as a density changing unit that changes the control target value of the toner density in a developing device 100.

When the control target value of the toner density in the developing device 100 of the single color unit 21 for a color for high toner adhesion in the high development mode is changed, the image forming apparatus 10 uses the controller 70 to drive the transport member 156 of the toner supply device 150 for the color for high toner adhesion and supply new toner to the developing device 100.

The image forming apparatus 10 uses the controller 70 to determine whether or not the image formation speed is to be changed to a lower speed than the image formation speed in the normal mode, in accordance with the operational environment (for example, the relative humidity) of the image forming apparatus 10 or time-varying change (for example, the remaining amount of the developer life) of the developer. Typically, as the relative humidity becomes higher, toner splatters (cloud) easily occur. Therefore, the image forming apparatus 10 uses the controller 70 to change the image formation speed to a lower speed than the image formation speed in the normal mode, for example, when the relative humidity detected by the humidity sensor 222 is equal to or greater than a first threshold (for example, 60%). In the present exemplary embodiment, when the relative humidity is equal to or greater than the first threshold (for example, 60%), the controller 70 determines that the relative humidity is high. Thus, the determination criterion for the high development mode is changed in accordance with the relative humidity. When the relative humidity is less than the first threshold (for example, 60%), the controller 70 does not change the image formation speed to a lower speed, and keeps the image formation speed in the normal mode.

When the developer in the developing device 100 is used for a long time, the toner charge decreases due to time-varying change in the developer, causing toner splatters (cloud) to occur easily. Therefore, the image forming apparatus 10 uses the controller 70 to calculate the remaining amount (%) of the developer life, for example, from the accumulated print count (accumulated formed-image count) or the pixel count (accumulated image density), for which printing has been actually performed, with respect to the available print count (formed-image count) or pixel count (accumulated image density). The counting unit 224 performs counting to obtain the accumulated print count (accumulated formed-image count) or the pixel count (accumulated image density) for which printing has been actually performed. For example, when the remaining amount of the developer life is equal to or less than a second threshold (for example, the remaining amount is 50%), the controller 70 changes the image formation speed to a lower speed than the image formation speed in the normal mode. Thus, the determination criterion for the high development mode is changed in accordance with the remaining amount of the developer life. When the remaining amount of the developer life is greater than the second threshold (for example, the remaining amount is 50%), the controller 70 does not change the image formation speed to a lower speed, and keeps the image formation speed at the speed in the normal mode. The remaining amount of the developer life is an exemplary life of the developer.

The controller 70 stores a speed change function of changing the speed of an image formation operation in the high development mode on the basis of the result of measurement of toner splatters (cloud) which is performed by changing the toner density in a developing device 100 and the image formation speed in an experiment performed in advance. The controller 70 changes the image formation speed in the high development mode to a lower speed (for example, the speed half the image formation speed in the normal mode) on the basis of the speed change function. The image formation speed in the high development mode may be changed to a lower speed stepwise in accordance with how high the toner density of the developing device 100 is.

When the image formation speed of the image forming apparatus 10 is to be decreased, the rotational speeds of the developing rollers 106, the first augers 109, and the second augers 111 of the developing devices 100 may be decreased (the drive rotational speeds may be decreased). When the speed is decreased, the mixing speeds (rotational speeds) of the first augers 109 and the second augers 111 of the developing devices 100 decrease. In addition, the image formation speed decreases. Thus, the formed-image count per mixing time apparently remains the same, avoiding or suppressing reduction in the toner chargeability.

An instruction to set or switch between the normal mode and the high development mode may be given, for example, by a user using the operation display unit 218. Alternatively, in the photograph (Photo) mode, when spot color (CT) toner is used, or when printing is performed in the high image density image, the controller 70 may switch the mode to the high development mode. For example, when an instruction to perform entire-area high-gloss printing by using clear (CR) toner as spot color (CT) toner, or printing with a high contrast ratio on a transparent film medium or a black recording medium by using white (W) toner as spot color (CT) toner is given, the mode is switched to the high development mode.

When the mode is switched from the high development mode to the normal mode, the image forming apparatus 10 does not perform toner density adjustment through ejection of toner from the developing device 100. When the mode is switched from the high development mode to the normal mode, the image forming apparatus 10 uses the controller 70 to perform an image formation operation at the image formation speed of the image forming apparatus 10 which is kept at a low speed until the formed-image count after the switching is equal to or greater than a third threshold (for example, until pixels whose number is equal to or greater than a pixel-count (image density) threshold are printed after the switching). That is, until the formed-image count after the switching is equal to or greater than the third threshold, printing is performed so that a determined amount of toner is consumed. Until then, the image formation speed is not returned to the normal speed.

Figure 4:
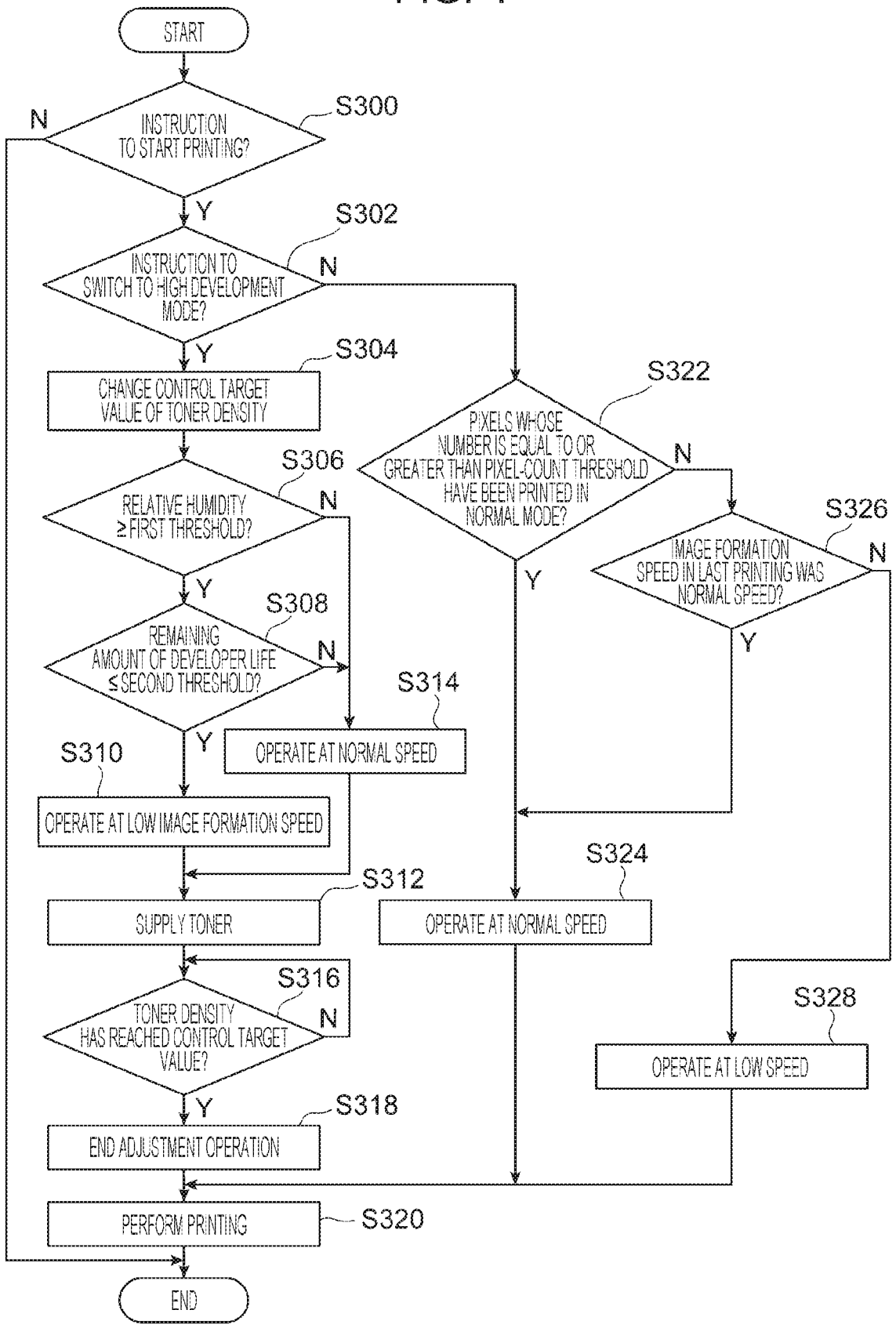
FIG. 4 is a flowchart illustrating the flow for speed control performed by the image forming apparatus according to the exemplary embodiment.

Referring to FIG. 4, operations performed by the image forming apparatus 10 in the case where the specific function described above is performed will be described.

FIG. 4 is a flowchart illustrating the flow of control of the image formation speed performed by the image forming apparatus 10 according to the present exemplary embodiment.

As illustrated in FIG. 4, the CPU 201 of the controller 70 determines whether or not an instruction to start printing has been given in step S300. If the determination result is negative, the routine ends.

If the determination result is positive in step S300, the CPU 201 causes the process to proceed to step S302, and determines whether or not an instruction to switch to the high development mode has been given. Examples of an instruction to switch to the high development mode include the case in which a user inputs the instruction by using the operation display unit 218, and the case in which the CPU 201 sets the high development mode when the photograph (Photo) mode or the spot color (CT) toner is to be used. When at least one of the single color units 21 is to form a toner image with a large amount of toner adhesion, the image forming apparatus 10 determines that an instruction to switch to the high development mode has been given.

If the determination result is positive in step S302, the CPU 201 causes the process to proceed to step S304, and changes the control target value of the toner density in the developing device 100 of the single color unit 21 for the color for which the instruction to switch to the high development mode has been given. For example, when the original control target value of the toner density in the developing device 100 in the normal mode ranges between 4% to 10%, the CPU 201 increases the control target value of the toner density in the developing device 100 by 1% to 2% with respect to the original control target value.

The CPU 201 causes the process to proceed to step S306, and determines whether or not the relative humidity detected by the humidity sensor 222 is equal to or greater than the first threshold (for example, 60%).

If the determination result is positive in step S306, the CPU 201 causes the process to proceed to step S308, and determines whether or not the remaining amount of the developer life of the developing device 100 of the single color unit 21 for the color for which the instruction to switch to the high development mode has been given is equal to or less than the second threshold (for example, the remaining amount is 50%). The CPU 201 calculates the remaining amount of the developer life from the accumulated print count (accumulated formed-image count) or the pixel count (accumulated image density) for which printing has been actually performed. The counting unit 224 performs counting to obtain the accumulated print count (accumulated formed-image count) or the pixel count (accumulated image density) for which printing has been actually performed.

If the determination result is positive in step S308, the CPU 201 causes the process to proceed to step S310, and causes the image forming apparatus 10 to operate in a state in which the image formation speed is kept at a low speed. That is, the image forming apparatus 10 changes, as preprocessing, the image formation speed to a low speed before supply of toner to the developing device 100.

The CPU 201 causes the process to proceed to step S312, and supplies toner to the developing device 100 of the single color unit 21 for the color for which the instruction to switch to the high development mode has been given. That is, the image forming apparatus 10 supplies toner to the developing device 100 as preprocessing of execution of printing. Specifically, the transport member 156 of the toner supply device 150 for the color for which the instruction to switch to the high development mode has been given is driven, and toner is supplied to the developing device 100. At that time, the CPU 201 also causes the first auger 109 and the second auger 111 (see FIG. 2) of the developing device 100 to rotate.

If the determination result is negative in step S306 or if the determination result is negative in step S308, the CPU 201 causes the process to proceed to step S314, and causes the image forming apparatus 10 to operate at the normal speed (normal image formation speed). After step S314, the CPU 201 causes the process to proceed to step S312.

After step S312, the CPU 201 causes the process to proceed to step S316, and determines whether or not the toner density in the developing device 100 of the single color unit 21 of the color for which the instruction to switch to the high development mode has been given has reached the control target value. The process waits until the determination result is positive, and proceeds to step S318. The CPU 201 ends the operation of adjusting the toner density in the developing device 100 in step S318.

The CPU 201 causes the process to proceed to step S320, and performs printing by using the image forming apparatus 10. Then, the routine ends.

If the determination result is negative in step S302, the CPU 201 causes the process to proceed to step S322, and determines whether or not pixels whose number is equal to or greater than the pixel-count (image density) threshold have been printed in the normal mode. The pixel-count (image density) threshold indicates pixels (image density)

counted from a time when the mode is returned from the high development mode to the normal mode. The pixel-count (image density) threshold is a value corresponding to the third threshold indicating the formed-image count after the switching.

If the determination result is positive in step S322, the CPU 201 causes the process to proceed to step S324, and causes the image forming apparatus 10 to operate at the normal speed (normal image formation speed). Then, the CPU 201 causes the process to proceed to step S320, and causes the image forming apparatus 10 to perform printing.

If the determination result is negative in step S322, the CPU 201 causes the process to proceed to step S326, and determines whether or not the image formation speed in the last printing was the normal speed.

If the determination result is positive in step S326, the CPU 201 causes the process to proceed to step S324, and causes the image forming apparatus 10 to operate at the normal speed (normal image formation speed).

If the determination result is negative in step S326, the CPU 201 causes the process to proceed to step S328, and causes the image forming apparatus 10 to operate at a low image formation speed. That is, the case in which the determination result is negative in step S326 is the case in which the image formation speed in the last printing is a low speed. Then, the CPU 201 causes the process to proceed to step S320, and causes the image forming apparatus 10 to perform printing. For example, when the mode is switched from the high development mode to the normal mode, until pixels whose number is equal to or greater than the pixel-count (image density) threshold are printed, the image forming apparatus 10 operates at a low image formation speed. That is, even when the state is returned from the state, in which the toner density in the developing device 100 has been increased due to the last instruction to switch to the high development mode, to the normal mode, until pixels whose number is equal to or greater than the pixel-count (image density) threshold are printed so that the toner density in the developing device 100 decreases, the speed of the image forming apparatus 10 is not returned to the normal speed (normal image formation speed).

In the image forming apparatus 10 described above, when at least one of the single color units 21 is in the high development mode, under the determined condition, the speed of an image formation operation is changed to a lower speed than the speed of an image formation operation in the normal mode. In the high development mode, the toner supply device 150 supplies new toner to the developing device 100. Thus, the toner is used with lower charge compared with the case in the normal mode. At that time, if the speed of an image formation operation is decreased, the mixing time is made long, and the toner charge is increased easily. In addition, the speed at which the toner hits the blades of the mixing members (in the present exemplary embodiment, the transport blades of the transport member 156, the first auger 109, and the second auger 111) decreases, making it difficult for the toner to splatter during an image formation operation.

Figure 5:
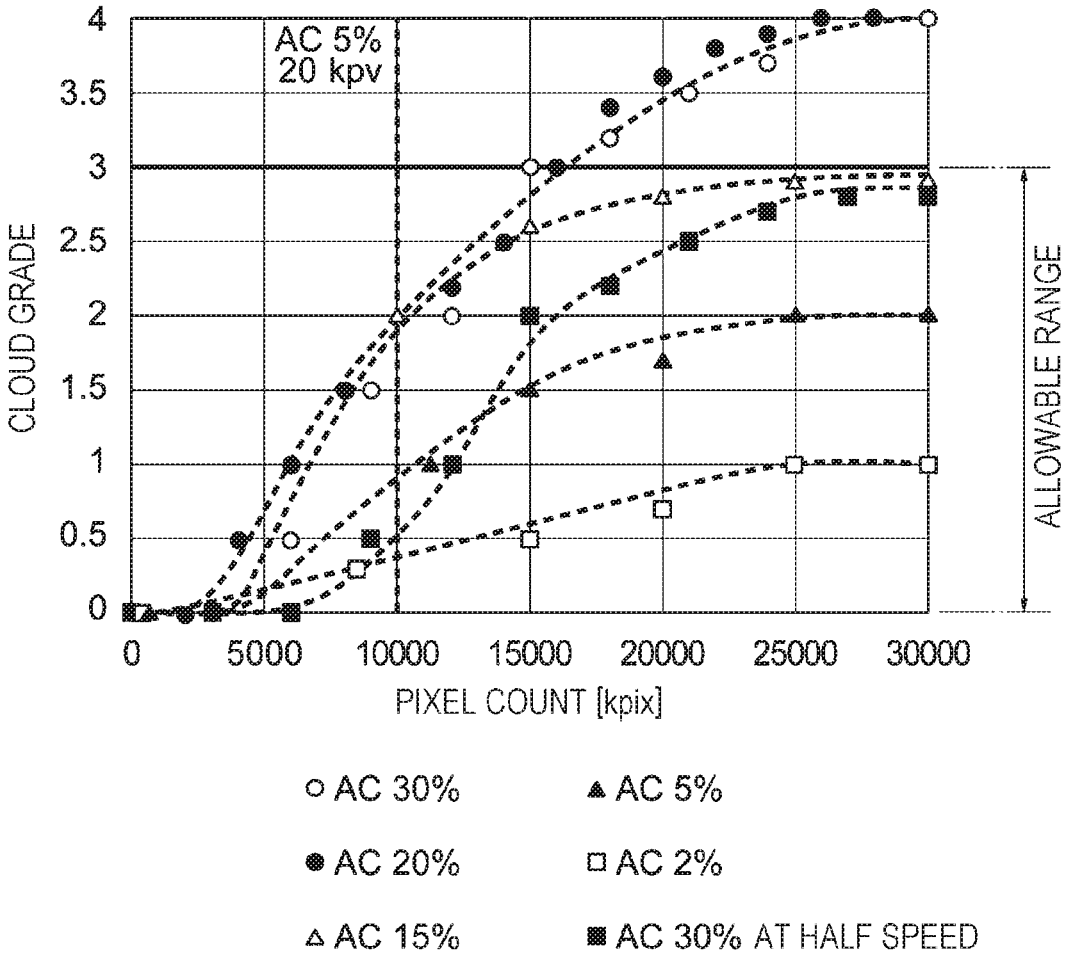
FIG. 5 is a graph indicating the relationship between toner cloud grade and pixel count depending on the toner density in a developing device.

FIG. 5 is a graph illustrating the relationship between cloud grade caused by a time-varying developer and pixel count (accumulated image density). In FIG. 5, the area coverage (AC) indicates toner consumption (toner image density) per unit area. The toner density in a developing device 100 is detected from the toner consumption (toner image density) per unit area. That is, the toner consumption (toner image density) per unit area is a value corresponding to the toner density (toner supply amount) in a developing device 100. As the value of the cloud grade increases, the amount of toner cloud increases. The cloud grade ranging between 0 and 3 inclusive is allowable, and tainted spots caused by the toner cloud (splatters) are inconspicuous. AC 30% at half speed indicates the image formation speed of the image forming apparatus 10 which is half the normal image formation speed. Except for AC 30% at half speed, the image formation speed of the image forming apparatus 10 is set to the normal speed.

As illustrated in FIG. 5, in the case of AC 30% for which the image formation speed of the image forming apparatus 10 is the normal speed, the amount of the toner cloud exceeds the allowable range. In contrast, in the case of AC 30% for which the image formation speed of the image forming apparatus 10 is half the normal image formation speed, it is found that the amount of toner cloud decreases to the allowable range.

Compared with the configuration in which the drive rotational speed of the developing devices or the speed of an image formation operation keeps at the same speed as the normal speed when a large amount of toner is to be adhered, the image forming apparatus 10 achieves suppression of occurrence of toner splatters, resulting in suppression of occurrence of a tainted background (fogging) of a sheet P.

In the high development mode, the image forming apparatus 10 changes the toner density in a developing device 100 to a high control target value (setting value). Therefore, compared with the configuration in which the setting value for toner density is not changed when a large amount of toner is to be adhered, the image forming apparatus 10 achieves suppression of a decrease in formed-image count. That is, reduction in the productivity of the image forming apparatus 10 is suppressed.

In the high development mode, the image forming apparatus 10 changes the drive rotational speed of the developing devices 100 or the speed of an image formation operation to a low speed in accordance with the relative humidity. That is, the condition under which the speed of an image formation operation is decreased is limited. Therefore, compared with the configuration in which, regardless of the relative humidity, the drive rotational speed of the developing devices or the speed of an image formation operation is changed to a low speed, the image forming apparatus 10 suppresses a decrease in the formed-image count.

In the present exemplary embodiment, when the relative humidity is less than the first threshold (for example, 60%) in the high development mode, the speed of an image formation operation is not changed to a low speed. That is, the speed of an image formation operation keeps at the speed in the normal mode. Therefore, compared with the configuration in which the drive rotational speed of the developing devices or the speed of an image formation operation is changed to a low speed when the relative humidity is low, the image forming apparatus 10 suppresses a reduction in the formed-image count.

In the high development mode, the image forming apparatus 10 changes the speed of an image formation operation to a low speed in accordance with the time-varying state of a developer. That is, the condition under which the speed of an image formation operation is made low is limited. Therefore, compared with the configuration in which, regardless of the time-varying state of a developer, the drive rotational speed of the developing devices or the speed of an image formation operation is changed to a low speed, the image forming apparatus 10 suppresses a decrease in the formed-image count.

In the present exemplary embodiment, when the remaining amount of the developer life (the life of a developer) is greater than the second threshold (for example, 50%) in the high development mode, the speed of an image formation operation is not changed to a low speed. That is, the speed of an image formation operation is kept at the speed in the normal mode. Therefore, compared with the configuration in which the drive rotational speed of the developing devices or the speed of an image formation operation is changed to a low speed when the life of a developer is long, the image forming apparatus 10 suppresses a decrease in the formed-image count.

When the mode is switched from the normal mode to the high development mode, after toner is supplied to a developing device 100 as preprocessing, the image forming apparatus 10 performs printing as an image formation operation. Therefore, compared with the configuration in which an image formation operation is performed before toner is supplied to a developing device, the image forming apparatus 10 suppresses a decrease in the formed-image count.

Before toner is supplied to a developing device 100 as preprocessing, the image forming apparatus 10 changes the speed of an image formation operation into a low speed. Thus, when toner is supplied from the toner supply device 150 to the developing device 100, toner is difficult to be splattered. Therefore, compared with the configuration in which the drive rotational speed of the developing devices or the speed of an image formation operation is not changed before toner is supplied to the developing device, the image forming apparatus 10 suppresses occurrence of toner splatters in the preprocessing.

When the mode is switched from the high development mode to the normal mode, the image forming apparatus 10 does not perform toner density adjustment through ejection of toner from a developing device 100. Therefore, compared with the configuration in which toner is ejected from a developing device when the mode is switched from the high development mode to the normal mode, the image forming apparatus 10 suppresses wasteful toner consumption.

When the mode is switched from the high development mode to the normal mode, until pixels whose number is equal to or greater than the pixel-count (image density) threshold are printed after the switching, the image forming apparatus 10 performs an image formation operation while keeping the image formation speed of the image forming apparatus 10 at a low speed. Therefore, compared with the case in which the drive rotational speed of the developing devices or the speed of an image formation operation is returned to the normal speed at the same time at which the mode is switched from the high development mode to the normal mode, the image forming apparatus 10 suppresses occurrence of toner splatters.

In the high development mode, the image forming apparatus 10 according to the above-described exemplary embodiment changes the speed of an image formation operation of the image forming apparatus 10 to a lower speed than the speed in the normal mode. The present disclosure is not limited to this. For example, in the high development mode, the drive rotational speed of the developing devices (for example, rotations of the developing rollers 106, the first augers 109, and the second augers 111) may be changed to a lower speed than the speed in the normal mode.

In the above-described exemplary embodiment, an example in which at least one of the single color units 21 forms a toner image in the high development mode is described. However, the present disclosure is not limited to this. For example, when only the single color unit 21CT for a spot color forms a toner image in the high development mode, under the determined condition, the speed of an image formation operation of the image forming apparatus may be changed to a lower speed than the speed in the normal mode. Instead, when only the single color unit 21CT for a spot color forms a toner image in the high development mode, while the speed of an image formation operation remains as it is, only the drive rotational speed of the developing device 100 of the single color unit 21CT for a spot color may be changed to a low speed. Compared with the case in which the drive rotational speed of the developing devices or the speed of an image formation operation is kept at the same speed as the normal speed when the spot-color image forming unit forms a toner image, this image forming apparatus suppresses occurrence of splatters of spot color toner. Further, compared with the case in which the image formation operations for all the colors are made slow, this image forming apparatus suppresses a decrease in the formed-image count.

In the above-described exemplary embodiment, the single color unit 21CT for a spot color is disposed upstream, in the direction in which the intermediate transfer belt 30 moves around, of the other single color units 21Y, 21M, 21C, and 21K. However, the present disclosure is not limited to this. The position of the single color unit 21CT for a spot color and the number of single color units 21CT may be changed. For example, the single color unit 21CT for a spot color may be disposed downstream, in the direction in which the intermediate transfer belt 30 moves around, of the other single color units 21Y, 21M, 21C, and 21K. In addition, two or more single color units 21CT for spot colors may be disposed.

In the above-described exemplary embodiment, an exemplary developing device 100 and an exemplary toner supply device 150 are described. The present disclosure is not limited to these. The configuration of the developing device and the configuration of the toner supply device may be changed.

The present disclosure is described in detail by using the specific exemplary embodiment. The present disclosure is not limited to the exemplary embodiment. It is clear for those skilled in the art that other various exemplary embodiments may be available in the scope of the present disclosure.

What is claimed is:

1. An image forming apparatus comprising:

a plurality of image forming units configured to form toner images of different colors on a transfer device, each of the plurality of image forming units including a developing device containing toner of a corresponding one of the different colors;

supply devices configured to supply toner to the developing devices; and at least one processor configured to execute a speed changing unit configured to, in a high development mode, change a drive rotational speed of a first one of the developing devices or the transfer device to a lower speed compared with a case of a normal mode, the normal mode being a mode in which a toner image is formed with a normal amount of toner adhesion, the high development mode being a mode in which at least one of the plurality of image forming units forms a toner image with a larger amount of toner adhesion than the normal mode, wherein the speed changing unit is configured to, in the high development mode, change the drive rotational speed of the first one of the developing devices or the transfer device to a lower speed in accordance with a time-varying state of a developer, and wherein the speed changing unit is configured to, if a life of the developer in the high development mode is greater than a second threshold, not change the drive rotational speed of the first one of the developing devices or the transfer device to a lower speed.

2. An image forming apparatus comprising:

a plurality of image forming units configured to form toner images of different colors on a transfer device, each of the plurality of image forming units including a developing device containing toner of a corresponding one of the different colors;

supply devices configured to supply toner to the developing devices; and at least one processor configured to execute a speed changing unit configured to, in a high development mode, change a drive rotational speed of a first one of the developing devices or the transfer device to a lower speed compared with a case of a normal mode, the normal mode being a mode in which a toner image is formed with a normal amount of toner adhesion, the high development mode being a mode in which at least one of the plurality of image forming units forms a toner image with a larger amount of toner adhesion than the normal mode, wherein the at least one processor is configured to execute:

a density changing unit configured to change a toner density of the first one of the developing devices to a setting value, the setting value being greater than a toner density in the normal mode, wherein the density changing unit is configured to, in the high development mode, change the toner density of the first one of the developing devices to the greater setting value, wherein the speed changing unit is configured to, in the high development mode, change the drive rotational speed of the first one of the developing devices or the transfer device to a lower speed in accordance with a time-varying state of a developer, and wherein the speed changing unit is configured to, if a life of the developer in the high development mode is greater than a second threshold, not change the drive rotational speed of the first one of the developing devices or the transfer device to a lower speed.

3. An image forming apparatus comprising:

a plurality of image forming units configured to form toner images of different colors on a transfer device, each of the plurality of image forming units including a developing device containing toner of a corresponding one of the different colors;

supply devices configured to supply toner to the developing devices; and at least one processor configured to execute a speed changing unit configured to, in a high development mode, change a drive rotational speed of a first one of the developing devices or the transfer device to a lower speed compared with a case of a normal mode, the normal mode being a mode in which a toner image is formed with a normal amount of toner adhesion, the high development mode being a mode in which at least one of the plurality of image forming units forms a toner image with a larger amount of toner adhesion than the normal mode, wherein the image forming apparatus is configured such that, if switching is performed from the normal mode to the high development mode, after toner is supplied to the first one of the developing devices as preprocessing, the image formation operation is performed, and wherein the image forming apparatus is configured such that, if switching is performed from the high development mode to the normal mode, until a formed-image count after the switching is equal to or greater than a third threshold, the image formation operation is performed while the drive rotational speed of the first one of the developing devices or the transfer device is kept at a lower speed.

* * * * *